US006836214B2

(12) United States Patent
Choi

(10) Patent No.: US 6,836,214 B2
(45) Date of Patent: Dec. 28, 2004

(54) BURGLAR ALARM

(76) Inventor: Sang J. Choi, 2425 W. 183rd St., Homewood, IL (US) 60430

( * ) Notice: Subject to any disclaimer, the term of this patent is extended or adjusted under 35 U.S.C. 154(b) by 0 days.

(21) Appl. No.: 10/608,955

(22) Filed: Jun. 30, 2003

(65) Prior Publication Data

US 2004/0036605 A1 Feb. 26, 2004

Related U.S. Application Data

(63) Continuation-in-part of application No. 10/086,823, filed on Mar. 4, 2002, now abandoned.

(51) Int. Cl.[7] ..... G08B 13/14

(52) U.S. Cl. ..... 340/568.3; 340/568.1; 340/568.2; 340/568.4; 340/571; 340/687

(58) Field of Search ..... 340/568.3, 571, 340/687, 825.25, 568.4, 568.2, 568.1; 713/200

(56) References Cited

U.S. PATENT DOCUMENTS 4,680,574 A * 7/1987 Ruffner ..... 340/571
4,736,195 A * 4/1988 McMurtry et al. ..... 340/568.3
4,945,341 A * 7/1990 Buttimer ..... 340/568.3
5,767,771 A * 6/1998 Lamont ..... 340/571
6,147,603 A * 11/2000 Rand ..... 340/568.2
6,150,940 A * 11/2000 Chapman et al. ..... 340/568.3

* cited by examiner

*Primary Examiner*—Davetta W. Goins

(57) ABSTRACT

An alarm apparatus attached to an electronic device, activated by unplugging AC power cord of the apparatus device from a power outlet, irrespective to the states of the main switch and the device switch. If the power cord is unplugged from the outlet, it disconnects DC continuity component from the alarm circuit, breaks a voltage divider circuit, changes the voltage level high, and activates the alarm system. The DC continuity component could be either an external component, the power transformer winding, or a device power input DC impedance. Which element is utilized is determined by the position of the main switch and the device switch. The alarm system can be turned on either by remote control or by a local switch. The alarm system is battery powered for its own circuit operation and can be charged by a battery charger.

12 Claims, 3 Drawing Sheets

A DEVICE WITH HIGH INPUT IMPEDANCE:

* AN ALARM AND AN ELECTRICAL DEVICE ARE CONNECTED IN PARALLEL ACROSS THE SAME OUTLET.

A DEVICE WITH LOW INPUT IMPEDANCE:

* AN ALARM CIRCUIT USES SEPARATE OUTLET FROM THAT OF AN ELECTRICAL DEVICE.

BURGLAR ALARM

This appl. is a continuation-in-part of U.S. appl. Ser. No. 10/086,823 filed Mar. 4, 2002, now abandoned.

BACKGROUND OF THE INVENTION

The importance of the protection of electronic/electrical devices from being stolen are emphasized since many such a valuable devices are used in hospitals, schools, and laboratories. Various alarm apparatus systems are invented and produced to fulfil the necessity arisen from the experiences that those expensive devices have been lost. There are many different ways to activate an alarm system by using different type of sensors or radio communication devices. Sensors have their inherent lapse in adjusting their sensitivity. If a sensor is adjusted too sensitive, it may cause false alarm while if it is adjusted too loosely, it may miss a triggering of the alarm. Some alarm systems use a motion detector as an alarming initiator. The installation of the detector itself requires a quite of work.

As of U.S. Pat. No. 5,767,771, unplugging a power cord from a outlet arms an alarm system. Lamont's system is actually activated by a motion sensor or a tempering switch like so many other alarm systems. When the main switch is turned off, the alarm circuit is on the stand by state, and unplugging the power cord does not affect the alarm circuit operation at all. The present system is actually activated by unplugging the power cord irrespective to the state of the main switch. The two systems, present invention and Lamont's system, are quite different functionally and in physical structure. Present invention and so many other systems are armed by simply turning power switch on. Lamont's system does not have a mechanism to turn the alarm off, once it is activated. My system will be turned off automatically after the predetermined period of time set by the timer circuit (34). The voltage level detector circuit in this invention detects whether the power cord is plugged or unplugged. Once it detects the disconnection of AC plug, it triggers timer circuit and activates the alarm. Alarming duration is determined by the RC timer circuit. Optionally, alarming duration can be extended until the system is turned off. In U.S. Pat. No. 4,736,195, McMurtry used comparator circuit. However, he used very complicated associated circuit that requires much more difficult design criteria. As of McMurtry system, as long as the main switch (320) is on, the alarm system is not working. The system also requires an AC signal generator, frequency divider, switch circuit. Designing those circuits must go through lots of trial and error process. If the diode (323) is a typical diode structure, it's forward voltage drop is 0.7 volts. The collector of the transistor (308) does not have much room for the voltage change. It looks simple but hard to set appropriate voltage level without false triggering, especially when AC is superimposed on the DC level.

The arrow headed side of power switch (320) is connected to the power transformer, which is connected in parallel with the appliance circuit. That is why if the switch (320) is closed, the alarm system does not work. Alarm will be on when the flip-flop (324) is on state. As the solution of all the aforementioned shortcomings of an alarm device, the present invention utilizes the method of unplugging power cord for activating an alarm system as explained in the summary part and in the detailed description section.

SUMMARY OF THE INVENTION

The present invention is regarding to a burglar alarm means which will be activated by unplugging the power cord connected to an alarm means and an electronic/electrical device in parallel. A voltage level detector circuit is checking the state of the power cord connection constantly. When the cord is unplugged or broken, it will generate a right polarity of output to said alarm apparatus. The alarm activator circuit inverts the detector output to the opposite polarity. Timer circuit is responsible to control the time length how long the alarm will be turned on. The power amplifier amplifies the output current to provide enough power to drive the sound device. The novel feature of this invention is the way activating an alarm device which is securely fastened or attached to an electronic/electrical apparatus. If a person try to move an electronic device from one location to another location, one should unplug the power cord from a power cord outlet. This will also disconnect the AC power from the alarm device and activate it because when the electronic device is unplugged, the alarm device is also unplugged. This method is quite different from the most other features such as motion sensor, infrared sensor, or shock sensor. Those sensing devices are very critical to adjust the sensitivity. The present invention's method to initiate an alarm condition is very straightforward, plugged or unplugged, no gray area. The sound device can be a speaker, buzzer, horn, chime, or any other noise generating apparatus. This invention will provide an alarm system which is economical to manufacture, easy to use and install, and versatile in it's function. To conserve the battery voltage, this system uses the CMOS devices for the voltage level detector, alarm activator, and the timer circuit. Optionally, this system uses a voltage charger circuit to charge the battery voltage.

DETAILED DESCRIPTION OF THE PREFERRED EMBODIMENT

Figure 1:
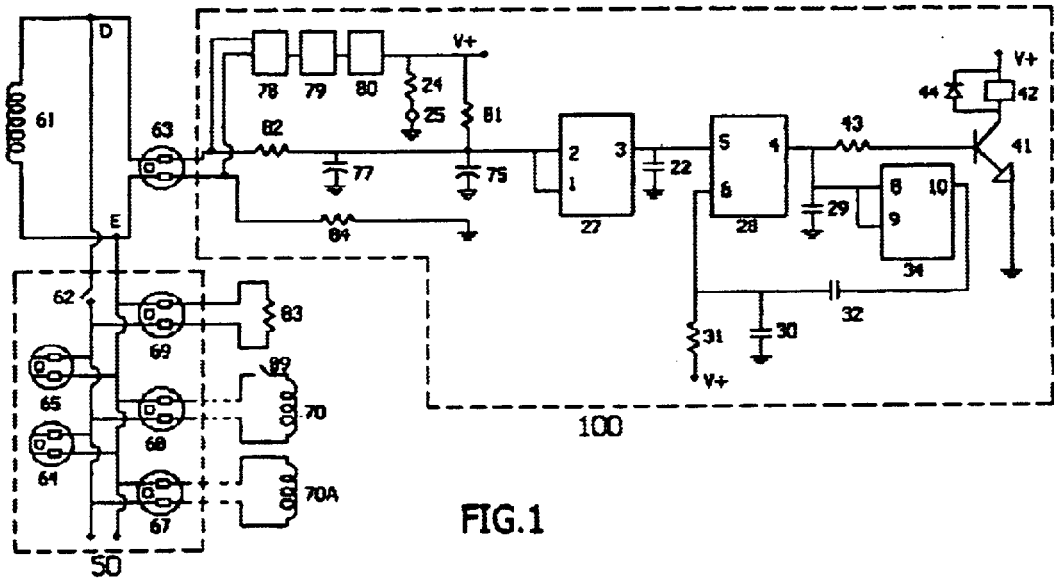
FIG. 1 is a detailed schematic of the present invention.

Referring to FIG. 1, it illustrates the schematic diagram showing in detailed level for the present invention of an alarm system designed to protect an electrical or an electronic apparatus from being burglarized. This circuit uses a battery (79), which provides the necessary power for the operation of the whole alarm circuit, and is charged by a battery charger (78).

All components value should be chosen such a way it saves power consumption during quiescent state. When switch (80) is closed, the battery voltage is connected to the alarm circuit and the LED (25) is lit. The resistor (24) is current limiting resistor to protect the LED (25).

(61) is AC input transformer winding, which connects AC voltage to multi power outlet strip (50), and single power outlet (63) which is connected to the transformer directly without going through a switch.

(62) is a main AC power switch for the power outlet strip (50).

Items, (63), (64), (65), (59), (67), and (68) are parallel connected power outlets.

(100) is alarm device circuit which includes AC cord status detection circuit and alarm activating circuit. Two power outlets (63, 68) are required for protecting an electrical or electronic device, one for the device and the other one for the alarm circuit. However, if an extra outlet can not be found, the power cord for the alarm device can use the outlet being used by the electronic device. To use the present alarm system, an electronic device does not have to be plugged. Irrespective to the position of the main switch (62), if cords for outlets (63) and (68) are unplugged to remove the device (70), the voltage level detector (27) output will be changed to opposite state, this state change will trigger the alarm system. Item (70) is shown to illustrate that if the input circuit of a device (such as computer) is DC open. Outlets (65) and (64) can be used for the same purpose for another device. This arrangement can be applied as many as needed. The outlet (69) is used to connect a 20K ohms 1W continuity resistor to provide a complete DC path for the alarm cords connected into the outlets of the multiple power strip (50). This DC path provides appropriate voltage drop across R82, R83, and R84, which is applied to the input of voltage level detector (27). If the outlet (63) is plugged, this voltage remains as low level. If the (63) is unplugged, this voltage is changed to high level. (78) is battery charger and (79) is a battery which provides the necessary power for the alarm side circuit. Capacitor (75) is a filtering capacitor, which filters (60) HZ AC components from entering to the inputs of the voltage level detector (27). Capacitors (77), (22), (30), (29) are high frequency filtering capacitors. These capacitors prevent false alarming caused by high frequency noise signal. The main part of the voltage level detector is a NAND GATE and associated circuit. A NOR GATE or an inverter can be used for the same purpose. A comparator also can be employed for this purpose. However, it consumes more power. That is why a NAND GATE is preferred over a comparator for this application. The two inputs of the NAND GATE are tied together and receive only one input for the pin (1) and pin (2). The input voltage is derived from the voltage divider circuit consisted of (81), (82), (83), and (84). If input at (27) is low level, the output of (27) is at high level. To meet this requirement (low output), the power cord for the alarm device should be unplugged, and the voltage level on the input of (27) is at high level. The main part of the alarm activator (28) is another NAND GATE with two separate inputs, one from voltage level detector (27) for activating the alarm state, and another one from the timer circuit (34) to control the timing duration of the alarming. The output of the alarm activator (28) activates the alarming circuit and initiates the timing of the alarming. If (63) is a wall outlet connected directly to the transformer winging (61) as shown in the Figure, (83) is not needed, because the transformer winding of (61) provides the necessary continuity for the voltage divider circuit of (81), (82), and (84). If the alarm circuit (100) is using the power outlet (65) instead of (63), and none of the apparatus, connected across power outlets strip (50), has low input impedance (below 20K ohms) and the switch (62) is open, then DC continuity component (83) should be installed. The DC continuity component (83) could be either a resistor, or an inductor, or a transformer winding which provides DC current path. If the power plug for the alarm device (100) is connected as shown, any time the plug is disconnected, it will set the alarm. If (100) is connected into (65), and switch (62) is open, and appliance (70A), which has the closed input impedance, is connected as shown, external continuity component (83) is not needed. However, if (83) is connected, for all cases, the alarm system will be activated by unplugging the power cord (63) of the alarm device. Under normal operation where power cord of the alarm device (100) is plugged, the input to the voltage level detector (27) is low level and the output of the alarm activator (28) is at low level and the alarm device is deactivated. If the power plug of the alarm (100) is unplugged from either outlet (63) or outlet (65), the input voltage to (27) is high level and the output of the alarm activator (28) is high level and triggers the alarm circuit (41 and 42). A sensor switch which detects the detachment of the alarm apparatus from the electronic device will activate alarming when it senses the separation of the two. The outlets (64) and (65) can be used for some other apparatus. When the alarm is activated, the output of the timer (34) is at low level, and capacitor (30) and resistor (31) keeps the input terminal (6) of the alarm activator (28) below the threshold level keeping the alarm system activated for the period determined by (31) and (32) even though the power plug is connected back. The same functions can be accomplished with two logic GATES instead of three logic GATES, (27), (28), and (34). However, with one additional GATE, more stable operation can be accomplished. NAND GATES (27), (28), and (34), and an unused NAND GATES are packaged in on IC chip as a quad 2 inputs NAND GATES chip.

Resistor (43) is the current limiting resistor for the current driver transistor (41). When transistor (41) is turned on, a buzzer or a speaker, or any other noise generating device (42) will make a noise. The diode (44) is to remove a high positive pulses from the collector of the power transistor (41), which may damage the transistor.

Figure 2:
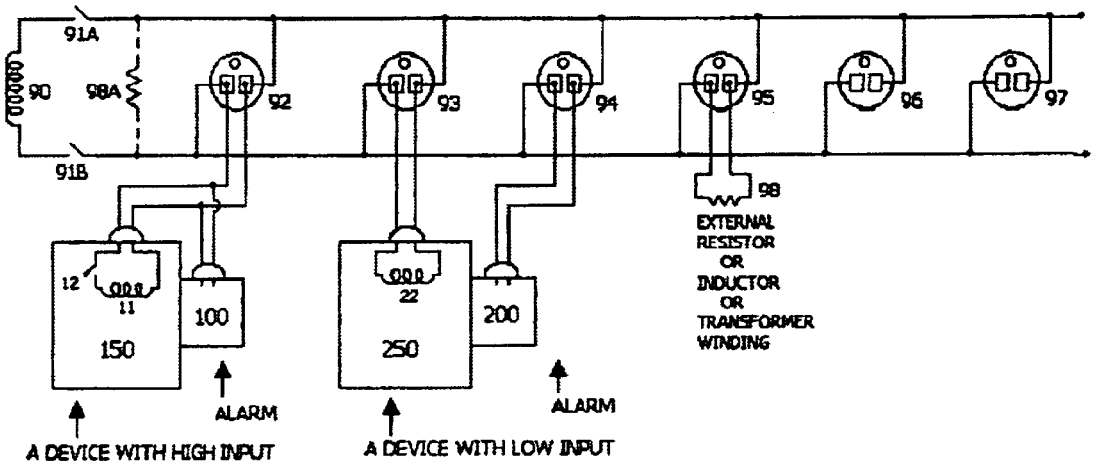
FIG. 2 is a connection diagram of a power outlet strip, an alarm device, And an electronic device.

FIG. 2 shows the connection diagram of power outlet assembly, electronic/electrical devices, and alarm apparatus.

Item 90 is a transformer winding across which AC voltage is delivered, 91A and 91B are main switches, 98 and 98A are external resistors, out of the two resistors, only one resistor needed depending upon which place is easy and convenient to install.

An electronic device (150) and an alarm system (100) both are connected to the same power outlet (92) in parallel. In this case, the input impedance of the device is very high or open circuited as shown by items (11) and (12). Many personal computers have this kind of features for the AC power input. The alarm system (100) is securely attached to the electronic device.

Another electronic device (250) is connected to the power outlet (93) and another alarm system (200) is connected to the power outlet (94). The power-input impedance of the device is very low as shown by item 22, that is why they are using separate power outlets for the external resistor not to be shorted out. External resistor (98) is connected to the power outlet (95). It is easy to connect the resistor across a power outlet. However, it can be connected next to power switch, if so desired, or any convenient place across two power wires between main switch and any power outlet. The power outlets (96 and 97) can be used for another electronic device and an alarm system combination.

More power outlets can be added according to the necessity.

Figure 3:
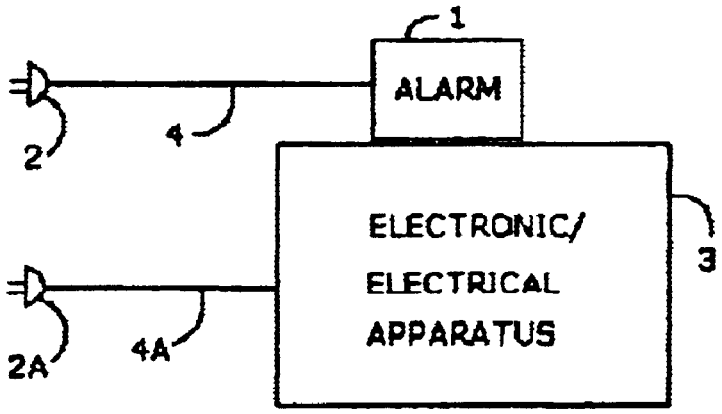
FIG. 3 is showing how power cords are connected to an electronic/electrical device and to an alarm apparatus of this invention.

FIG. 3 shows an alarm device (1) of this invention mounted on an electronic/electrical device (3). Epoxy glue or some other type of double face adhesive strips can be used for attaching securely the alarm device to an electronic apparatus, or special case (housing) can be made with appropriate mounting bracket on it. FIG. 3 also shows the way power cords are connected. To move said electronic device (3), the cord (4) connected to said alarm device should be unplugged or broken because said alarm (1) is securely attached to the electronic device (3). This will activate the alarm.

Figure 4:
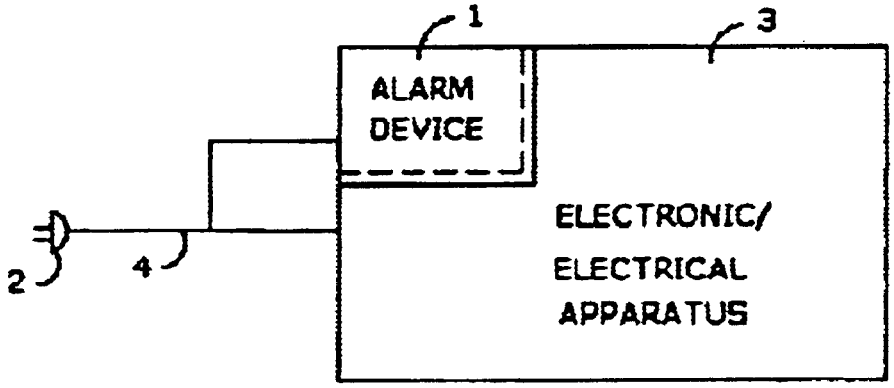
FIG. 4 is showing that said alarm device is mounted inside the housing (case) of said electronic device.

FIG. 4 is showing that said alarm (1) is mounted inside the housing of the electronic device (3). A split power cord (4) is directly connected to any available power outlet. Said alarm device may be mounted on an inconspicuous place inside or outside of said electrical apparatus (3).

Figure 5:
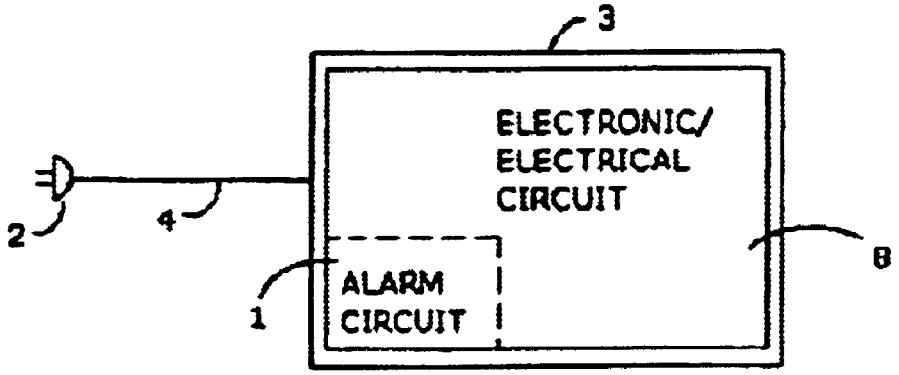
FIG. 5 is illustrating that said alarm circuit is included on the Printed Circuit Board of said electronic device.

FIG. 5 illustrates that said alarm circuit (1) is assembled on a portion of the printed circuit board (8) of said electronic device (3) during manufacturing process.

In the broader aspects, this invention is not limited to the specific embodiment illustrated and described herein.

Those skilled in the art may make various changes and modifications without departing from the scope and spirit of the present invention. It is the expressed intention of this invention to embrace all such changes and modifications which fall within the scope of the described claims thereby.

What I claim is:

1. A burglar alarm apparatus attached to an electronic or electrical device comprising:

a) an alarm circuit and a power cord for plugging into an AC power outlet; said AC power outlet may include an AC power switch;

b) said alarm circuit and said power cord connected to said burglar alarm;

c) a DC continuity component connected external of, and electrically in parallel with said burglar alarm apparatus across a power outlet;

d) a case for housing said burglar alarm apparatus; and e) a mounting means for securely attaching said burglar alarm apparatus to said electronic or electrical device wherein said burglar alarm apparatus is activated by unplugging, or shorting, or breaking said power cord, or activated by detaching said burglar alarm apparatus from said electronic or electrical device, irrespective of the state of a main AC power switch and/or an electronic device switch.

2. A burglar alarm apparatus according to claim 1, wherein, if the power cord of the alarm apparatus is connected into a hot power outlet, a transformer winding, across which AC voltage is induced, takes place the DC continuity component.

3. A burglar alarm apparatus according to claim 1, wherein, if the DC power input impedance of any electronic/electrical device is low and the device is connected electrically in parallel with the alarm apparatus across a separate power outlet, the input impedance of the electronic device take place the DC continuity component.

4. A burglar alarm apparatus according to claim 1, wherein the activated alarm state can not be deactivated by plugging the power cord back in, once activated, the alarming state continues until the time determined by the timer circuit elapses.

5. A method of activating an alarm apparatus including the steps of:

a) securely attaching said alarm apparatus to an electronic device;

b) connecting a power cord to said alarm apparatus and for plugging said power cord into an AC power outlet, said AC power outlet may include a main AC power switch; and c) connecting a DC continuity component electrically in parallel with and physically external to said alarm apparatus across a separate power outlet; whereby, unplugging, shorting, or breaking a power cord connected to said alarm apparatus will cause said activation of said alarm apparatus, irrespective of the position of a main AC power switch and/or of said electronic device switch.

6. A method of activating an alarm apparatus according to claim 5, attaching the alarm device securely to the electronic devices, causing alarming sound to follow physically the electronic devices being removed (or stolen) automatically after said power cord has been removed.

7. A method of activating an alarm apparatus according according to claim 5, taking the place of the DC continuity component by a power transformer winding, which connects induced AC voltage directly to the power outlet where the power cord of the alarm apparatus is connected.

8. A method of activating an alarm apparatus according to claim 5, taking the place of the DC continuity component by low input impedance of the electronic device, which is connected in parallel with the alarm apparatus across a separate power outlet.

9. A method of activating an alarm apparatus according to claim 5, providing that DC power input impedance of the electronic device is high, embedding an alarm circuit of the alarm apparatus into an electronic device circuit as part of it with a common power cord for said alarm circuit and said device circuit, wherein the alarm circuit is activated when the common power cord is disconnected from a power outlet, irrespective of the position of main switch or the device switch.

10. A burglar alarm apparatus according to claim 1, wherein the alarm circuit and power cord further comprises:

a) a DC battery for providing power to said alarm circuit;

b) an alarm switch means of either locally operative mechanical or programmable electronic switch or remotely controlled switch for enabling or disabling said alarm apparatus;

c) a voltage charger means for charging the DC battery, wherein the application of the charger is optional, since power consumption of the alarm apparatus is very minute, the voltage charger can be eliminated where it has constraint of space and/or weight;

d) a voltage divider circuit which includes plurality of resistors and AC filter circuit which includes plurality of capacitors, wherein two resistors of the voltage divider, (82 and 84 of FIG. 1), and one capacitor of the filter, (77 of FIG. 1), are included either in a power plug of the power cord, or in the alarm circuit;

e) a voltage level detector producing an appropriate output logic level either low or high level depending upon the power cord state of being unplugged or plugged respectively;

f) an alarm activator for providing an appropriate output logic level representative of the state of said power cord;

g) a timer circuit for determining the time during which the alarm is activated;

h) a sound device for generating an audible sound;

i) a driver for amplifying the output current high enough to drive said sound device;

j) the level detector, the alarm activator, and the timer circuit are packed in a quad 2 input IC chip.

11. A burglar alarm apparatus according to claim 1, wherein if a DC input impedance of said Electronic device is high, power cords of said alarm apparatus and the Electronic device can be connected in parallel and, two together can be connected into a same power outlet, or both said device and said apparatus can use a common power cord.

12. A method of activating an alarm apparatus according to claim 5, if a DC input impedance of said Electronic device is high, connecting power cords of the alarm apparatus and the Electronic device in parallel, and connecting two cords together into a same power outlet, or making a common power cord for both, said device and said apparatus.

* * * * *